US006838149B2

(12) United States Patent
Lugg

(10) Patent No.: US 6,838,149 B2
(45) Date of Patent: Jan. 4, 2005

(54) ABRASIVE ARTICLE FOR THE DEPOSITION AND POLISHING OF A CONDUCTIVE MATERIAL

(75) Inventor: Paul S. Lugg, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 37 days.

(21) Appl. No.: 10/021,161

(22) Filed: Dec. 13, 2001

(65) Prior Publication Data

US 2003/0113509 A1 Jun. 19, 2003

(51) Int. Cl.[7] ..... B24D 11/00

(52) U.S. Cl. ..... 428/137; 428/156; 451/552; 51/295; 205/87

(58) Field of Search ..... 428/137, 156, 428/131, 134, 158, 159, 163, 167, 168; 451/552, 533, 534, 530; 51/295, 297, 294, 293, 296; 205/87

(56) References Cited

U.S. PATENT DOCUMENTS

| | | | | |
|---|---|---|---|---|
| 4,314,827 | A | 2/1982 | Leitheiser et al. | 51/298 |
| 4,623,364 | A | 11/1986 | Cottringer et al. | 51/309 |
| 4,652,274 | A | 3/1987 | Boettcher et al. | 51/298 |
| 4,744,802 | A | 5/1988 | Schwabel | 51/309 |
| 4,770,671 | A | 9/1988 | Monroe et al. | 51/295 |
| 4,879,258 | A | 11/1989 | Fisher | 437/225 |
| 4,881,951 | A | 11/1989 | Monroe et al. | 51/307 |
| 4,903,440 | A | 2/1990 | Kirk et al. | 51/298 |
| 5,061,294 | A | 10/1991 | Harmer et al. | 51/295 |
| 5,081,796 | A | 1/1992 | Schultz | 51/165.74 |
| 5,137,542 | A | 8/1992 | Buchanan et al. | 51/295 |
| 5,152,917 | A | 10/1992 | Pieper et al. | 51/295 |
| 5,196,353 | A | 3/1993 | Sandhu et al. | 437/8 |
| 5,203,884 | A | 4/1993 | Buchanan et al. | 51/295 |
| 5,236,472 | A | 8/1993 | Kirk et al. | 51/298 |
| 5,378,252 | A | 1/1995 | Follensbee | 51/298 |
| 5,433,651 | A | 7/1995 | Lustig et al. | 451/6 |
| 5,609,511 | A | 3/1997 | Moriyama et al. | 451/5 |
| 5,609,517 | A | 3/1997 | Lofaro | 451/529 |
| 5,658,185 | A | 8/1997 | Morgan, III et al. | 451/36 |
| 6,007,407 | A | 12/1999 | Rutherford et al. | 451/41 |
| 6,103,628 | A | 8/2000 | Talieh | 438/692 |
| 6,106,371 | A | 8/2000 | Nagahara et al. | 451/59 |
| 6,328,872 | B1 | 12/2001 | Talieh et al. | 205/206 |

FOREIGN PATENT DOCUMENTS

| | | |
|---|---|---|
| WO | WO 98/49723 | 11/1998 |
| WO | WO 00/59008 | 10/2000 |
| WO | WO 00/59682 | 10/2000 |
| WO | WO 01/04944 | 1/2001 |

*Primary Examiner*—Harold Pyon
*Assistant Examiner*—Alicia Chevalier

(57) ABSTRACT

An abrasive article is described. The article is suitable for the deposition and mechanical polishing of a conductive material, and comprises: a polishing layer having a textured surface comprising a binder and a second surface opposite the textured surface, the polishing layer further comprising a first channel extending therethrough; a backing having a first backing surface and a second backing surface, the first backing surface associated with the second surface of the polishing layer, the backing comprising a second channel coextensive with the first channel and extending through the backing from the first backing surface to the second backing surface; the first channel and the second channel dimensioned with respect to one another so that the textured surface of the polishing layer is outside of a line of sight.

20 Claims, 6 Drawing Sheets

ABRASIVE ARTICLE FOR THE DEPOSITION AND POLISHING OF A CONDUCTIVE MATERIAL

The present invention relates to an abrasive article suitable for use in preferentially depositing and polishing conductive material on a semiconductor workpiece surface.

BACKGROUND OF THE INVENTION

In the manufacture of semi-conductor wafers, metals are deposited onto the face of the wafers, typically over a barrier or seed layer of metal, to form an electronic circuitry on the workpiece. Recent interest in the use of copper as a preferred metal for use in the formation of semiconductor circuitry is motivated, at least in part, by a desire to provide conductive circuitry with lowered electrical resistance, less heat generation and a finished semi-conductor chip with increased capacity and efficiency. While chemical vapor deposition and electroplating techniques have been used to fill the via holes and trenches within silicon-based substrates, these processes generally have been very expensive and have experienced high defect densities.

The task of providing an electronic circuitry for the semi-conductor workpiece surface has required separate process steps for first depositing the metal and subsequently polishing it. Such multi-step methods have been performed on systems for electrolytic deposition having an anode and a cathode with electrolytic solutions serving as the source of metal ions. Such multi-step techniques have required first that the conductive material be deposited directly onto the surface of the workpiece. Thereafter, a separate polishing step is required, typically involving a chemical-mechanical polishing process utilizing an abrasive slurry and a conventional polishing pad to polish the surface of the wafer to the degree needed. The deposition step and the polishing step have generally been performed at separate stations in the semiconductor manufacturing line.

Recently, electro-chemical mechanical deposition ("ECMD") methods and equipment have been described in the art. See, for example, U.S. Pat. No. 6,176,992 which describes the electrolytic deposition of a conductive material within the vias on the surface of a semi-conductor wafer while avoiding the deposition of the same conductive material at locations on the surface of the wafer outside of the vias. The conductive material is electrolytically deposited onto the workpiece surface. A slurry-free abrasive process is described to polish the conductive material after the metal has initially been deposited. Alternatively, the abrasive article may be used in a process that simultaneously deposits and polishes conductive material on the exposed surface of the semiconductor wafer. The disclosed apparatus includes an anode associated with an abrasive article and capable of receiving a first potential upon application of power. The abrasive article or pad is positioned between the anode and the wafer. The exposed surface of the wafer is conductive and receives a negative electric potential to thereby operate as the cathode to receive a second potential opposite the first potential upon application of power and to facilitate the deposition of conductive material (e.g., copper or other metal) onto the wafer surface from a suitable electrolyte solution. The abrasive article is moveable with respect of the exposed surface of the wafer to polish the wafer surface and thereby avoid the need for a separate polishing step using an abrasive slurry.

Although a significant advance in the art, the aforementioned deposition and polishing of an electrolyte on the semi-conductor wafer surface has not been free of technical issues. The delivery of electrolyte solution to the surface of the wafer and the simultaneous or near simultaneous polishing of the conductive material formed from the electrolyte has resulted in the need for abrasive articles of a well defined configuration. Such an abrasive article will be constructed to allow the delivery of the electrolyte solution and plating current through the fixed abrasive and directly onto the wafer surface. While this construction permits the selective delivery of the electrolyte and the electrical plating current to the desired areas of the wafer, the application of plating current during the deposition process has occasionally caused plating of conductive material onto the working surface of the abrasive article. The presence of plated metal on the working surface of the abrasive article can scratch the working surface of the wafer as well as shorten the working life of the abrasive article.

For at least the foregoing reasons, there is a need for an abrasive article for use in ECMD wherein the article is constructed to permit the flow of electrolyte therethrough while minimizing the aforementioned problem of metal plating on the working surface of the abrasive.

SUMMARY OF THE INVENTION

The invention provides an abrasive article suitable for the deposition and mechanical polishing of a conductive material, the article comprising:

A polishing layer having a textured surface comprising a binder and a second surface opposite the textured surface, the polishing layer further comprising a first channel extending therethrough;

A backing having a first backing surface and a second backing surface, the first backing surface associated with the second surface of the polishing layer, the backing comprising a second channel coextensive with the first channel and extending through the backing from the first backing surface to the second backing surface; and The first channel and the second channel being dimensioned with respect to one another such that the textured surface of the polishing layer is outside of a line of sight.

The textured surface may comprise a plurality of abrasive composites that may be precisely shaped abrasive composites. The first channel and the second channel are dimensioned with respect to one another such that the textured surface of the polishing layer is outside of a line of sight by at least about 0.2 mm. The first surface of the textured surface may also comprise abrasive particles fixed within the binder.

As used herein, certain terms shall be understood to have the following meanings:

"Line of sight" refers to the visual field of an observer looking through an abrasive article, wherein the observer's visual field is defined by an aggregate of line segments projecting from the electrode associated with the second surface of the backing (e.g., the anode) through the second and first channels (described herein) of the abrasive article to define and encompass a region at the interface between the abrasive article and a semiconductor workpiece where the textured surface of the abrasive article does not contact the semiconductor surface during an ECMD deposition and polishing operation. In other words, if the textured surface of the abrasive article is placed in contact with the surfaces of the semiconductor workpiece with an observer positioned nearest the anode and the backing of the abrasive article and looking through the second channel, the observer will not be able see any areas of the textured surface that are in contact with the surface of the workpiece, because all such areas of contact will be out of the observer's visual field or line of sight.

"Rigid element" refers to an element which is of higher modulus than the resilient element and which deforms in flexure.

"Resilient element" refers to an element which supports the rigid element and elastically deforms in compression.

"Modulus" refers to the elastic modulus or Young's Modulus of a material; for a resilient material it is measured using a dynamic compressive test in the thickness direction of the material, whereas for a rigid material it is measured using a static tension test in the plane of the material.

"Textured" when used to describe a polishing layer on an abrasive article herein refers to a surface having raised portions and recessed portions in which at least the raised portions comprise a binder and, optionally, abrasive materials (e.g., particles) fixed and dispersed within the binder.

"Abrasive composite" refers to one of a plurality of shaped bodies which collectively provide a textured abrasive article comprising a binder and, optionally, abrasive materials such as abrasive particles and/or agglomerates of particles.

"Precisely shaped abrasive composite" refers to an abrasive composite having a molded shape that is the inverse of the mold cavity which is retained after the composite has been removed from the mold, as described in U.S. Pat. No. 5,152,917 (Pieper et al.).

Those skilled in the art will more fully appreciate the features of the present invention upon further consideration of the disclosure herein, including the various figures, the detailed description of the preferred embodiments and the appended claims.

BRIEF DESCRIPTION OF THE DRAWINGS

In describing the preferred embodiment of the present invention, reference is made to the various Figures in which like elements are indicated by like reference numerals and wherein.

DETAILED DESCRIPTION OF THE PREFERRED EMBODIMENT

The present invention provides an abrasive article that permits the placement of conductive material within vias, trenches and/or through-holes or at other desired locations on the surface of a semi-conductor workpiece while minimizing or avoiding the deposition of conductive material in undesired locations along the workpiece surface. The abrasive article of the invention is useful in ECMD processes. The article has a textured polishing surface capable of polishing conductive material on the semi-conductor workpiece surface. The abrasive article can be used in conjunction with polishing efforts for any of a variety of conductive materials including copper, for example.

Figure 1:
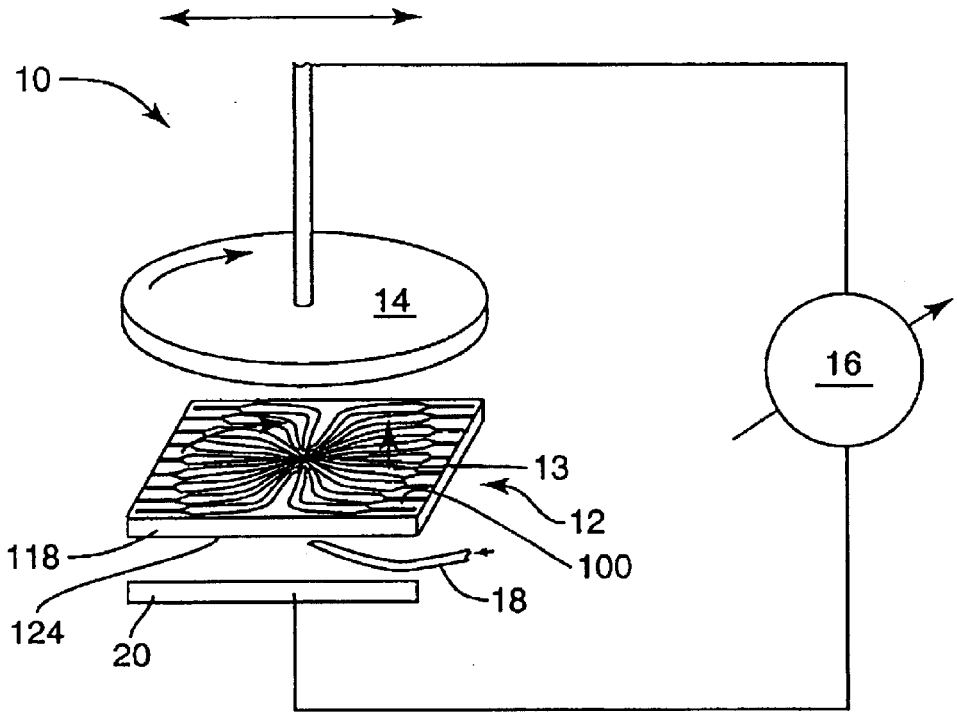
FIG. 1 is an elevated side view, in schematic, of a portion of a system incorporating an abrasive article according to an embodiment of the present invention.

Referring to the various figures, an embodiment of the invention is shown and will now be described. FIG. 1, for example, schematically illustrates an ECMD system 10. A fixed abrasive article 12 is provided. The system 10 allows the article 12 to be positioned in contact with the surface of semiconductor wafer 14. A plating solution of metal ions is delivered to the article 12 via a feedline 18. The plating solution is directed through channels or apertures 13 in the article 12 and then to the exposed surface of the semiconductor wafer 14. The plating solution serves as a source of metal ions for plating metal onto the surface of the wafer 14. The metal is deposited from the plating solution onto the surface of the wafer 14 by the application of a variable electric potential 16 across the interface of the abrasive article 12 and the wafer 14. The surface of the wafer 14 is typically provided with a metallic seed layer or the like so that its surface is conductive and will serve as a cathode. The anode 20 is generally positioned so that the abrasive article 12 is between the anode 20 and the wafer/cathode 14, providing a positive potential and source of metal ions.

The negatively charged surface of the wafer 14 attracts the metal ions of the plating solution that flows from the feedline 18, through the apertures 13 in the abrasive article 12 and to the exposed surface of the wafer 14. Under the application of electric potential, the metal will plate onto the wafer surface, preferably in the through-holes, vias and/or trenches, for example. To facilitate polishing, the abrasive article 12 includes a polishing layer 100, and the article 12 and wafer 14 may be rotated with respect to one another. Also, means may be provided for the simultaneous or sequential side-to-side movement of the abrasive article 12 and/or the semiconductor wafer 14.

Metal plating on the surface of the wafer 14 may be controlled by masking areas of the wafer with, for example, the abrasive article 12 or with a separate mask (not shown). Using the article 12 as a mask during the plating step generally requires that the wafer 14 and the abrasive article 12 be held in contact with one another during the application of the electrolyte solution. In this manner, both plating current and plating solution pass through the apertures 13 to specific areas on the surface of the wafer 14 that are defined by the geometry of the apertures 13, and plating of the metal occurs mainly in the unmasked areas of the wafer surface exposed to the plating solution. While the metal is deposited, the abrasive article 12 and the wafer 14 may be moved relative to one another, such as by rotation of one or both of the wafer 14 and/or the abrasive article 12. The movement of the article 12 relative to the surface of the wafer 14 facilitates the polishing of the previously deposited metal.

Figure 2:
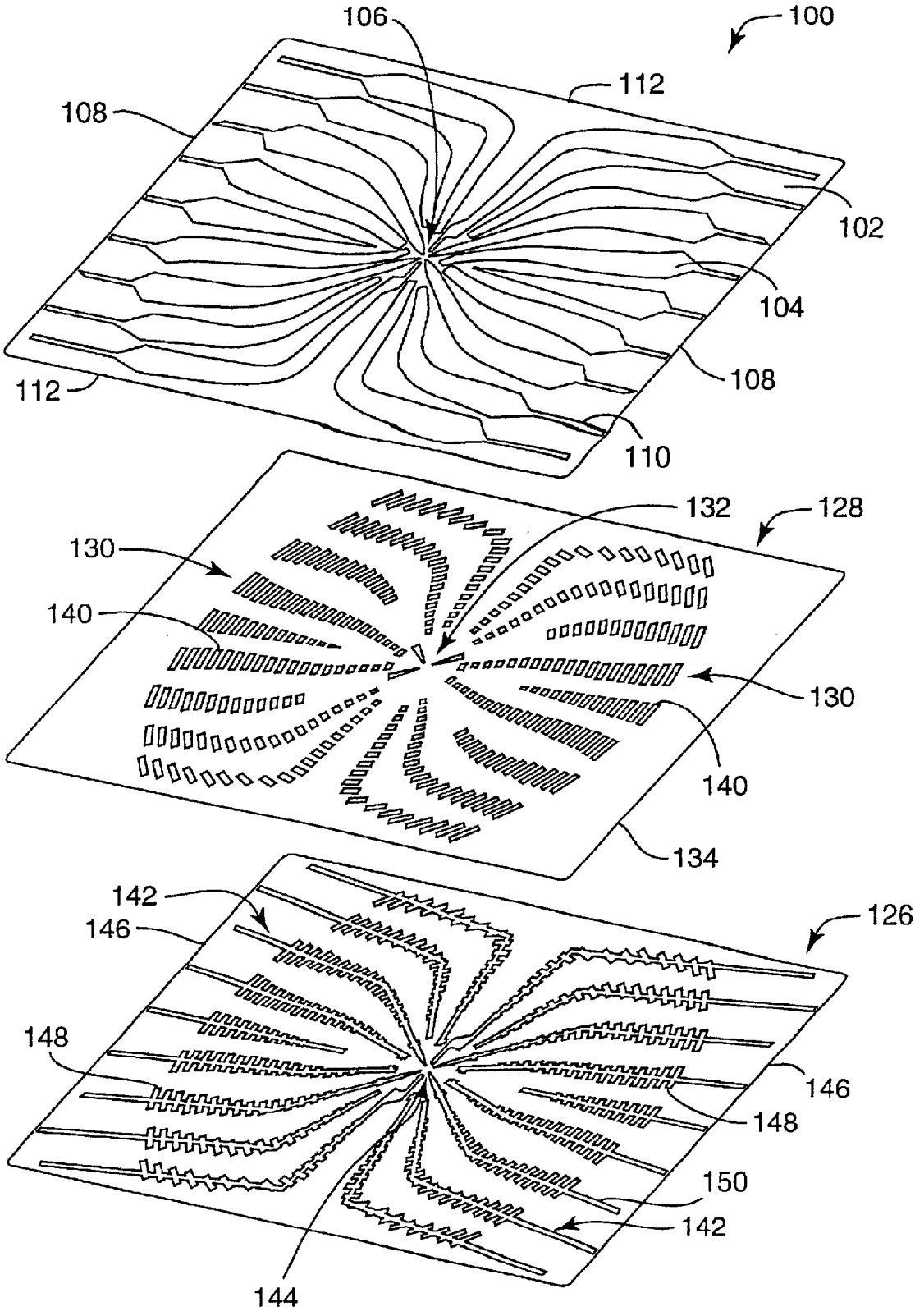
FIG. 2 is an exploded view, in perspective, of an abrasive article according to an embodiment of the invention.

FIG. 2 is an exploded view of a fixed abrasive article 12 constructed in accordance with an embodiment of the invention. The article 12 comprises a polishing layer 100 having a first surface 102. Layer 100 may be supported by a back-up pad 118 (see FIG. 4) comprised of at least a rigid element 128 and a resilient element 126. The layers 100, 128 and 126 are typically affixed to one another such as by a suitable adhesive, for example. The first surface 102 is the working surface of the polishing layer 100. As such, the first surface 102 is provided with an abrasive texture that will provide a polishing force to the surface of the semiconductor workpiece 14. The texture given to the first surface 102 of polishing layer 100 can include irregular surface structures as well as regular surface structures. It will be appreciated that the back-up pad 118 provides support for the polishing layer 100, and that other means of support are possible and are contemplated as being within the scope of the invention.

Figure 4:
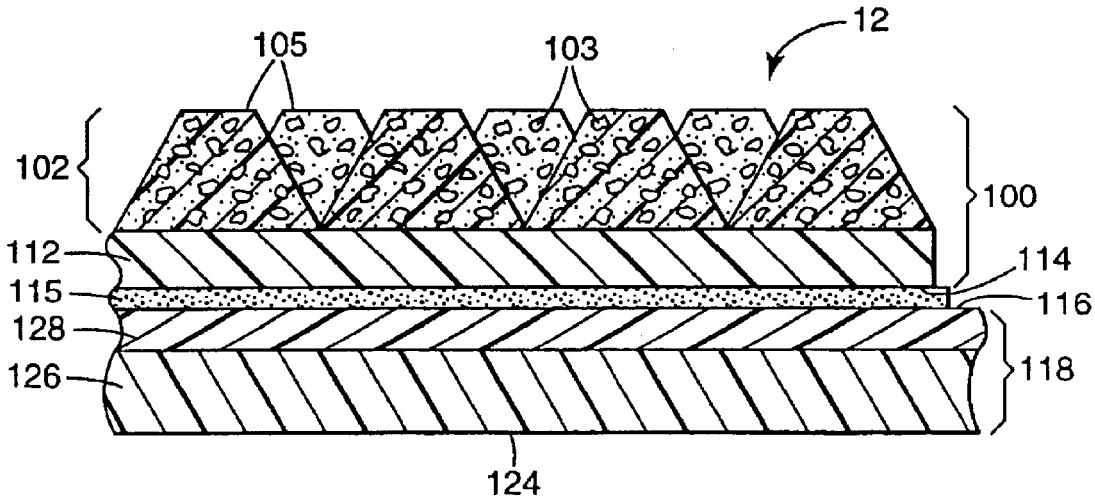
FIG. 4 is a sectional view illustrating a portion of an abrasive article according to an embodiment of the invention.

The textured first surface 102 of the polishing layer 100 will typically comprise a solidified binder that may optionally include a plurality of abrasive materials, such as abrasive particles and/or abrasive agglomerates, fixed and dispersed therein. The texture of the first surface 102 of the polishing layer 100 can be imparted thereto by any of a variety of methods known to those in the art. Coating techniques such as gravure coating, for example, may be employed in the manufacture of the polishing layer 100 to impart the desired degree of texture to the first surface. Other techniques may also be employed including molding techniques such as those described in U.S. Pat. No. 5,152,917 (Pieper et al.) for example, to provide precisely shaped abrasive composites 103, as are shown in FIG. 4. The polishing layer 100 also includes a second or back surface (not shown) opposite the first surface 102. The second surface is associated with another surface such as to the surface of the rigid element 128. Typically, the second surface is adhesively affixed to the rigid element 128.

Figure 3:
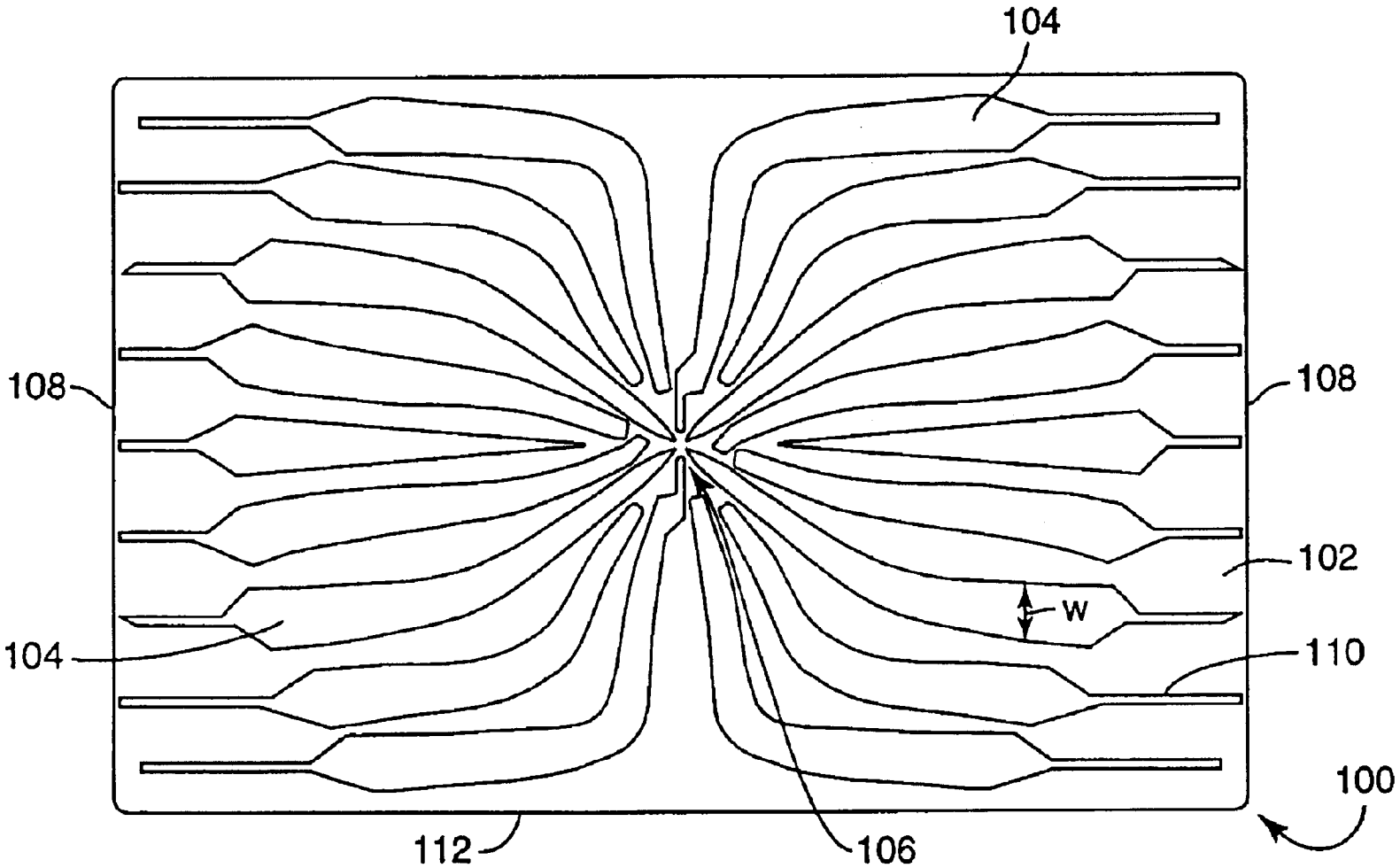
FIG. 3 is a plan view of a portion of the abrasive article of FIG. 2.

Referring to FIG. 3, the polishing layer 100 includes a first channel 104 extending through the layer 100 from the first surface 102 to a second surface (not shown) opposite the first surface. The polishing layer 100 typically includes a plurality of first channels 104, each first channel 104 extending from a centermost area, generally indicated at 106, and terminating proximate to one of two sides 108. As shown, each first channel 104 has a width "w" that varies along the length of the channel. The width of each of the channels 104 is dimensioned so that an appropriate area of the wafer 14 is exposed to the electrolyte solution to thereby enable the deposition of an amount of conductive metal appropriate for circuit formation. The channels 104 have a proximal end thereof nearest to the centermost area 106 and a distal end that extends to the edges 108 of the layer 100, terminating in a narrow channel portion or distal channel portion 110. The distal channel portion permits drainage of excess electrolyte solution from the interface between the abrasive article 12 and the wafer 14.

The first surface 102 of the polishing layer 100 is textured in a manner suitable for polishing the surface of the wafer 14. The texture of the surface 102 includes raised portions and recessed portions in which at least the raised portions comprise a binder material. Abrasive materials, such as abrasive particles, may be fixed and dispersed within the binder of the first surface 102. It will be appreciated by those skilled in the art that various configurations are possible for the polishing layer and the abrasive article in general. For example, the aforementioned channels 104 may be provided in a configuration different than the laterally extending channels 104 depicted in the Figures and described above. One such alternative would be distinct apertures or one or more series of apertures positioned in the polishing layer for the purpose of delivering plating solution to the exposed surface of a semiconductor wafer. Apertures may be provided in any configuration and the surface of the abrasive article may include any number of such apertures arranged in any manner whatsoever, such as in a circular array, linear array, and the like. The present invention is not intended to be limited to any particular configuration for the polishing layer, the textured surface or the channels therein.

The polishing layer may be manufactured from a binder precursor material, such as a resin or a polymeric material, that can be prepared initially as a liquid or as a semi-solid material and subsequently solidified or cured to a provide a hardened material suitable for polishing semiconductor wafers. Materials suitable for use in the manufacture of the polishing layer include organic binder precursors originally in a flowable state but converted to a hardened binder during the manufacture of the abrasive article. The hardened binder is in a solid, non-flowable state. The binder can be formed from a thermoplastic material, or the binder can be formed from a material that is capable of being crosslinked (e.g., a thermosetting resin). It is also within the scope of this invention to have a mixture of a thermoplastic binder and a crosslinked binder. During the process of making the abrasive article, the binder precursor is exposed to the appropriate conditions to solidify the binder. For crosslinkable or chain extendable binder precursors, the binder precursor is exposed to the appropriate energy source to initiate the polymerization or curing and to form the binder. Thus after curing, the binder precursor is converted into a binder.

The binder precursor may be an organic material that is capable of being crosslinked and/or chain extended. These binder precursors can be either a condensation curable resin or an addition polymerizable resin. The addition polymerizable resins can be ethylenically unsaturated monomers and/or oligomers. Examples of useable crosslinkable or chain extendable materials include phenolic resins, bismaleimide binders, vinyl ether resins, aminoplast resins having pendant alpha, beta unsaturated carbonyl groups, urethane resins, epoxy resins, acrylate resins, acrylated isocyanurate resins, urea-formaldehyde resins, isocyanurate resins, acrylated urethane resins, acrylated epoxy resins, or mixtures thereof.

Condensation curable resins may be used as well. Phenolic resins are widely used in abrasive article binder because of their thermal properties, availability, cost and ease of handling. There are two types of phenolic resins, resole and novolac. Resole phenolic resins have a molar ratio of formaldehyde to phenol of greater than or equal to one, typically between 1.5:1.0 to 3.0:1.0. Novolac resins have a molar ratio of formaldehyde to phenol of less than to one to one. Examples of commercially available phenolic resins include those known by the tradenames "Durez" and "Varcum" from Occidental Chemicals Corp.; "Resinox" from Monsanto; "Arofene" from Ashland Chemical Co. and "Arotap" from Ashland Chemical Co.

Latex resins may also be used, either alone or in combination with other resins. Latex resins can be mixed, for example, with a phenolic resin and include acrylonitrile butadiene emulsions, acrylic emulsions, butadiene emulsions, butadiene styrene emulsions and combinations thereof. These latex resins are commercially available from a variety of different sources including: "Rhoplex" and "Acrylsol" commercially available from Rohm and Haas Company, "Flexcryl" and "Valtac" commercially available from Air Products & Chemicals Inc., "Synthemul" and "Tylac" commercially available from Reichold Chemical Co., "Hycar" and "Goodrite" commercially available from B.F. Goodrich, "Chemigum" commercially available from Goodyear Tire and Rubber Co., "Neocryl" commercially available from ICI, "Butafon" commercially available from BASF and "Res" commercially available from Union Carbide.

Epoxy resins have an oxirane group and are polymerized by the ring opening. Such epoxide resins include monomeric epoxy resins and polymeric epoxy resins. These resins can vary greatly in the nature of their backbones and substituent groups. For example, the backbone may be of any type normally associated with epoxy resins and substituent groups thereon can be any group free of an active hydrogen atom that is reactive with an oxirane ring at room temperature. Representative examples of acceptable substituent groups include halogens, ester groups, ether groups, sulfonate groups, siloxane groups, nitro groups and phosphate groups. Examples of some preferred epoxy resins include 2,2-bis[4-(2,3-epoxypropoxy)-phenyl)propane (diglycidyl ether of bisphenol A)] and commercially available materials under the trade designation "Epon 828", "Epon 1004" and "Epon 1001F" available from Shell Chemical Co., "DER-331", "DER-332" and "DER-334" available from Dow Chemical Co. Other suitable epoxy resins include glycidyl ethers of phenol formaldehyde novolac (e.g., "DEN-431" and "DEN-428" available from Dow Chemical Co.

Ethylenically unsaturated binder precursors may include aminoplast monomer or oligomer having pendant alpha, beta unsaturated carbonyl groups, ethylenically unsaturated monomers or oligomers, acrylated isocyanurate monomers, acrylated urethane oligomers, acrylated epoxy monomers or oligomers, ethylenically unsaturated monomers or diluents, acrylate dispersions or mixtures thereof. The aminoplast binder precursors have at least one pendant alpha, beta-unsaturated carbonyl group per molecule or oligomer. These materials are further described in U.S. Pat. Nos. 4,903,440 and 5,236,472, both incorporated herein after by reference. The ethylenically unsaturated monomers or oligomers may be monofunctional, difunctional, trifunctional or tetrafunctional or even higher functionality. The term acrylate includes both acrylates and methacrylates. Suitable ethylenically unsaturated binder precursors include both monomeric and polymeric compounds that contain atoms of carbon, hydrogen and oxygen, and optionally, nitrogen and the halogens. Oxygen or nitrogen atoms or both are generally present in ether, ester, urethane, amide, and urea groups. Ethylenically unsaturated compounds preferably have a molecular weight of less than about 4,000 and are preferably esters made from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, maleic acid, and the like. Representative examples of ethylenically unsaturated monomers include methyl methacrylate, ethyl methacrylate, styrene, divinylbenzene, hydroxy ethyl acrylate, hydroxy ethyl methacrylate, hydroxy propyl acrylate, hydroxy propyl methacrylate, hydroxy butyl acrylate, hydroxy butyl methacrylate, vinyl toluene, ethylene glycol diacrylate, polyethylene glycol diacrylate, ethylene glycol dimethacrylate, hexanediol diacrylate, triethylene glycol diacrylate, trimethylolpropane triacrylate, glycerol triacrylate, pentaerthyitol triacrylate, pentaerythritol trimethacrylate, pentaerythritol tetraacrylate and pentaerythritol tetramethacrylate. Other ethylenically unsaturated resins include monoallyl, polyallyl, and polymethallyl esters and amides of carboxylic acids, such as diallyl phthalate, diallyl adipate, and N,N-diallyladipamide. Still other nitrogen containing compounds include tris(2-acryl-oxyethyl) isocyanurate, 1,3,5-tri (2-methyacryloxyethyl)-s-triazine, acrylamide, methylacrylamide, N-methylacrylamide, N,N-dimethylacrylamide, N-vinyl-pyrrolidone, and N-vinyl-piperidone.

Isocyanurate derivatives having at least one pendant acrylate group and isocyanate derivatives having at least one pendant acrylate group are further described in U.S. Pat. No. 4,652,274, incorporated herein after by reference. The preferred isocyanurate material is a triacrylate of tris(hydroxy ethyl) isocyanurate.

Acrylated urethanes are acrylate esters of hydroxy terminated isocyanate extended polyesters or polyethers. Examples of commercially available acrylated urethanes include "UVITHANE 782", available from Morton Chemical, and "CMD 6600", "CMD 8400", and "CMD 8805", available from UCB Radcure Specialties. Acrylated epoxies are acrylate esters of epoxy resins, such as the acrylate esters of bisphenol A epoxy resin. Examples of commercially available acrylated epoxies include "CMD 3500", "CMD 3600", and "CMD 3700", available from UCB Radcure Specialties.

Additional details concerning acrylate dispersions can be found in U.S. Pat. No. 5,378,252 (Follensbee), incorporated herein after by reference.

It is also within the scope of this invention to use a partially polymerized ethylenically unsaturated monomer in the binder precursor. For example, an acrylate monomer can be partially polymerized and incorporated into the abrasive slurry. The degree of partial polymerization should be controlled such that the resulting partially polymerized ethylenically unsaturated monomer does not have an excessively high viscosity so that the resulting abrasive slurry can be coated to form the abrasive article. An example of an acrylate monomer that can be partially polymerized is isooctyl acrylate. It is also within the scope of this invention to use a combination of a partially polymerized ethylenically unsaturated monomer with another ethylenically unsaturated monomer and/or a condensation curable binder.

In the present invention, acrylate and epoxy binders have been used. Suitable acrylate binders include 2-phenoxyethylacrylate, propoxylated 2 neopentyl glycol diacrylate, polyethylene glycol diacrylate, pentaerythritol triacrylate, 2-(2-ethoxyethoxy) ethyl acrylate and others. Suitable epoxy binders include bisphenol A diglycidyl ether, 1,4-butanediol diglycidyl ether and others. The epoxy binders can be cured in combination with amines, amides or by acid catalyzed polymerization.

The abrasive coating of this invention can include optional additives, such as, abrasive material surface modification additives, coupling agents, plasticizers, fillers, expanding agents, fibers, antistatic agents, initiators, suspending agents, photosensitizers, lubricants, wetting agents, surfactants, pigments, dyes, UV stabilizers and suspending agents. The amounts of these materials are selected to provide the properties desired.

The abrasive coating may further comprise a plasticizer. In general, the addition of the plasticizer will increase the erodibility of the abrasive coating and soften the overall binder hardness. Examples of plasticizers include polyvinyl chloride, dibutyl phthalate, alkyl benzyl phthalate, polyvinyl acetate, polyvinyl alcohol, cellulose esters, phthalate, silicone oils, adipate and sebacate esters, polyols and their derivatives, t-butylphenyl diphenyl phosphate, tricresyl phosphate, castor oil, combinations thereof, and the like.

The abrasive coating can further optionally comprise a filler to toughen the coating. Conversely, in some instances with the appropriate filler and amount, the filler may increase the erodibility of the abrasive coating. A filler is a particulate material and generally has an average material size range between 0.1 to 50 micrometers, typically between 1 to 30 micrometers. Examples of useful fillers for this invention include: metal carbonates (such as calcium carbonate (chalk, calcite, marl, travertine, marble and limestone), calcium magnesium carbonate, sodium carbonate, magnesium carbonate), silica (such as quartz, glass beads, glass bubbles and glass fibers) silicates (such as talc, clays, (montmorillonite) feldspar, mica, calcium silicate, calcium metasilicate, sodium aluminosilicate, sodium silicate) metal sulfates (such as calcium sulfate, barium sulfate, sodium sulfate, aluminum sodium sulfate, aluminum sulfate), gypsum, vermiculite, wood flour, aluminum trihydrate, carbon black, metal oxides (such as calcium oxide (lime), aluminum oxide, tin oxide (e.g. stannic oxide), titanium dioxide) and metal sulfites (such as calcium sulfite), thermoplastic materials (polycarbonate, polyetherimide, polyester, polyethylene, polysulfone, polystyrene, acrylonitrile-butadiene-styrene block copolymer, polypropylene, acetal polymers, polyurethanes, nylon particles) and thermosetting materials (such as phenolic bubbles, phenolic beads, polyurethane foam materials and the like). The filler may also be a salt such as a halide salt. Examples of halide salts include sodium chloride, potassium cryolite, sodium cryolite, ammonium cryolite, potassium tetrafluoroboate, sodium tetrafluoroborate, silicon fluorides, potassium chloride, magnesium chloride. Examples of metal fillers include, tin, lead, bismuth, cobalt, antimony, cadmium, iron titanium. Other miscellaneous fillers include sulfur, organic sulfur compounds, graphite and metallic sulfides. The above mentioned examples of fillers are meant to be a representative showing of fillers, and it is not meant to encompass all fillers.

Examples of antistatic agents include graphite, carbon black, vanadium oxide, conductive polymers, humectants, and the like. These antistatic agents are disclosed in U.S. Pat. Nos. 5,061,294; 5,137,542, and 5,203,884, incorporated herein after by reference.

The binder precursor may further comprise a curing agent. A curing agent is a material that helps to initiate and complete the polymerization or crosslinking process such that the binder precursor is converted into a binder. The term curing agent encompasses initiators, photoinitiators, catalysts and activators. The amount and type of the curing agent will depend largely on the chemistry of the binder precursor.

When the textured surface 102 of polishing layer 100 includes abrasive materials therein, the materials can be selected from any of a variety of materials. For example, inorganic abrasive materials and/or organic based materials may be suitable for use in the article. Inorganic abrasives materials can be divided into hard inorganic abrasive materials (i.e., having a Mohs hardness greater than 8) and soft inorganic abrasive materials (i.e., having Mohs hardness less than 8). Examples of conventional hard abrasive materials include fused aluminum oxide, heat treated aluminum oxide, white fused aluminum oxide, black silicon carbide, green silicon carbide, titanium diboride, boron carbide, tungsten carbide, titanium carbide, diamond, cubic boron nitride, garnet, fused alumina zirconia, sol gel abrasive materials and the like. Examples of sol gel abrasive materials can be found in U.S. Pat. Nos. 4,314,827, 4,623,364; 4,744,802, 4,770,671; 4,881,951, all incorporated herein after by reference.

Examples of conventional softer inorganic abrasive materials include silica, iron oxide, chromia, ceria, zirconia, titania, silicates and tin oxide. Still other examples of soft abrasive materials include: metal carbonates (such as calcium carbonate (chalk, calcite, marl, travertine, marble and limestone), calcium magnesium carbonate, sodium carbonate, magnesium carbonate), silica (such as quartz, glass beads, glass bubbles and glass fibers) silicates (such as talc, clays, (montmorillonite) feldspar, mica, calcium silicate, calcium metasilicate, sodium aluminosilicate, sodium silicate) metal sulfates (such as calcium sulfate, barium sulfate, sodium sulfate, aluminum sodium sulfate, aluminum sulfate), gypsum, aluminum trihydrate, graphite, metal oxides (such as calcium oxide (lime), aluminum oxide, titanium dioxide) and metal sulfites (such as calcium sulfite), metal materials (tin, lead, copper and the like) and the like.

Plastic abrasive materials can be formed from a thermoplastic material such as polycarbonate, polyetherimide, polyester, polyethylene, polysulfone, polystyrene, acrylonitrile-butadiene-styrene block copolymer, polypropylene, acetal polymers, polyvinyl chloride, polyurethane, polyurea, nylon and combinations thereof. In general, thermoplastic polymers for use in the invention may typically have a high melting temperature or good heat resistance properties. There are several ways to form a thermoplastic abrasive particle. One such method is to extrude the thermoplastic polymer into elongate segments and then cut these segments into the desired length. Alternatively, the thermoplastic polymer can be molded into the desired shape and particle size. This molding process can be compression molding or injection molding. The plastic abrasive particles can be formed from a crosslinked polymer. Examples of crosslinked polymers include: phenolic resins, aminoplast resins, urethane resins, epoxy resins, melamineformaldehyde, acrylate resins, acrylated isocyanurate resins, urea-formaldehyde resins, isocyanurate resins, acrylated urethane resins, acrylated epoxy resins and mixtures thereof. These crosslinked polymers can be made, crushed and screened to the appropriate particle size and particle size distribution. Both thermoset and thermoplastic polymeric abrasive particles may be formed by emulsion polymerization.

The abrasive article may also contain a mixture of two or more different abrasive particles. In the mixture of two or more different abrasive particles, the individual abrasive particles may have the same average particle size, or alternatively the individual abrasive particles may have a different average particle size. In yet another aspect, there may be a mixture of inorganic abrasive particles and organic abrasive particles.

The abrasive particle can be treated to provide a surface coating thereon. Surface coatings are known to improve the adhesion between the abrasive particle and the binder in the abrasive article. Additionally, the surface coating may also improve the ability of the abrasive particles to be dispersed in the binder precursor. Alternatively, surface coatings can alter and improve the cutting characteristics of the resulting abrasive particle.

In one embodiment, the polishing layer comprises a hardened acrylate binder made from a binder precursor comprising two acrylate monomers, dispersing agent, initiator and an alumina grit. The acrylate resins, commercially available from Sartomer of Exton, Pa., are (1) propoxylated-2-neopentyl glycol diacrylate sold under the trade designation "Sartomer SR 9003" and (2) 2-phenoxyethyl acrylate sold under the trade designation "Sartomer SR 339. A dispersing agent is added to the binder precursor such as that sold by BYK Chemie of Wallingford, Conn. under the trade designation "Dysperbyk D111." To initiate polymerization, an initiator is present in the binder precursor such as that known as "Irgacure 819" available from Ciba Giegy of Tarrytown, N.Y. Aluminum oxide abrasive particles may also be added to the binder precursor to impart an abrasive character to the finished article. One such abrasive is "Tizox" alpha alumina available from Ferro Corp. of Penn Yan, N.Y.

The binder may be shaped into a plurality of precisely shaped abrasive composites, each composite comprising abrasive particles fixed and dispersed within a binder. The abrasive particles may be chosen according to the needs of the user giving consideration to the surface being polished, the desired hardness of the available abrasives, and other factors known to those skilled in the art. Typically, the abrasives will have a Mohs hardness within the range from about 2 to about 10. Abrasive particles having hardnesses within this range will provide the needed level of abrasive action for polishing conductive materials in the semiconductor workpiece.

Referring to FIG. 4, a section of an abrasive article 12 according to the invention is depicted. The first surface 102 of the polishing layer 100 comprises precisely shaped three-dimensional fixed abrasive composites 103 affixed to an optional support 112. The composites 103 provide the first surface 102 with a texture suited for the polishing operation. The second surface 114 of the polishing layer 100 is affixed to the first backing surface 116 using an adhesive layer 115. Suitable adhesives for the adhesive layer 115 include pressure sensitive adhesives (PSA) such as polyolefin, polyacrylate or polyurethane PSAs available from Minnesota Mining and Manufacturing Company ("3M") of St. Paul, Minn. In particular, PSAs having the designations "3M 9671LE" or "3M 9471FL" and available from 3M have been successfully used in the manufacture of the abrasive article 12. The backing 118 comprises at least two layers 126 and 128 and a second backing surface 124 opposite the polishing layer 100. In the depicted embodiment, the backing 118 and the at least two layers comprise a resilient element 126 with a rigid element 128 interposed between the resilient element 126 and the fixed abrasive composites 103. The modulus of the resilient element 126 (i.e., Young's Modulus in the thickness direction of the material) is at least about 25% and as much as at least about 50% less than the modulus of the rigid element 128 (i.e., Young's Modulus in the plane of the material). Moreover, the rigid element 128 may have a Young's Modulus of at least about 100 MPa, and the resilient element 126 has a Young's Modulus of less than about 100 MPa. The Young's Modulus of the resilient element 126 is typically less than about 50 MPa.

The rigid and resilient elements, 128 and 126, combine to provide a backing in the form of a back-up pad 118 (FIG. 4) attached to support layer 112 of the fixed abrasive composites 103 on the polishing layer 100. The back-up pad 118 is described in detail in U.S. Pat. No. 6,007,407 to Rutherford et al., the disclosure on which is incorporated by reference herein. During an ECMD process, the second backing surface 124 of the resilient element 126 may be attached to the platen of an ECMD apparatus. In operation, the surfaces 105 of the fixed abrasive elements 103 normally contact the semiconductor wafer workpiece.

Figure 5:
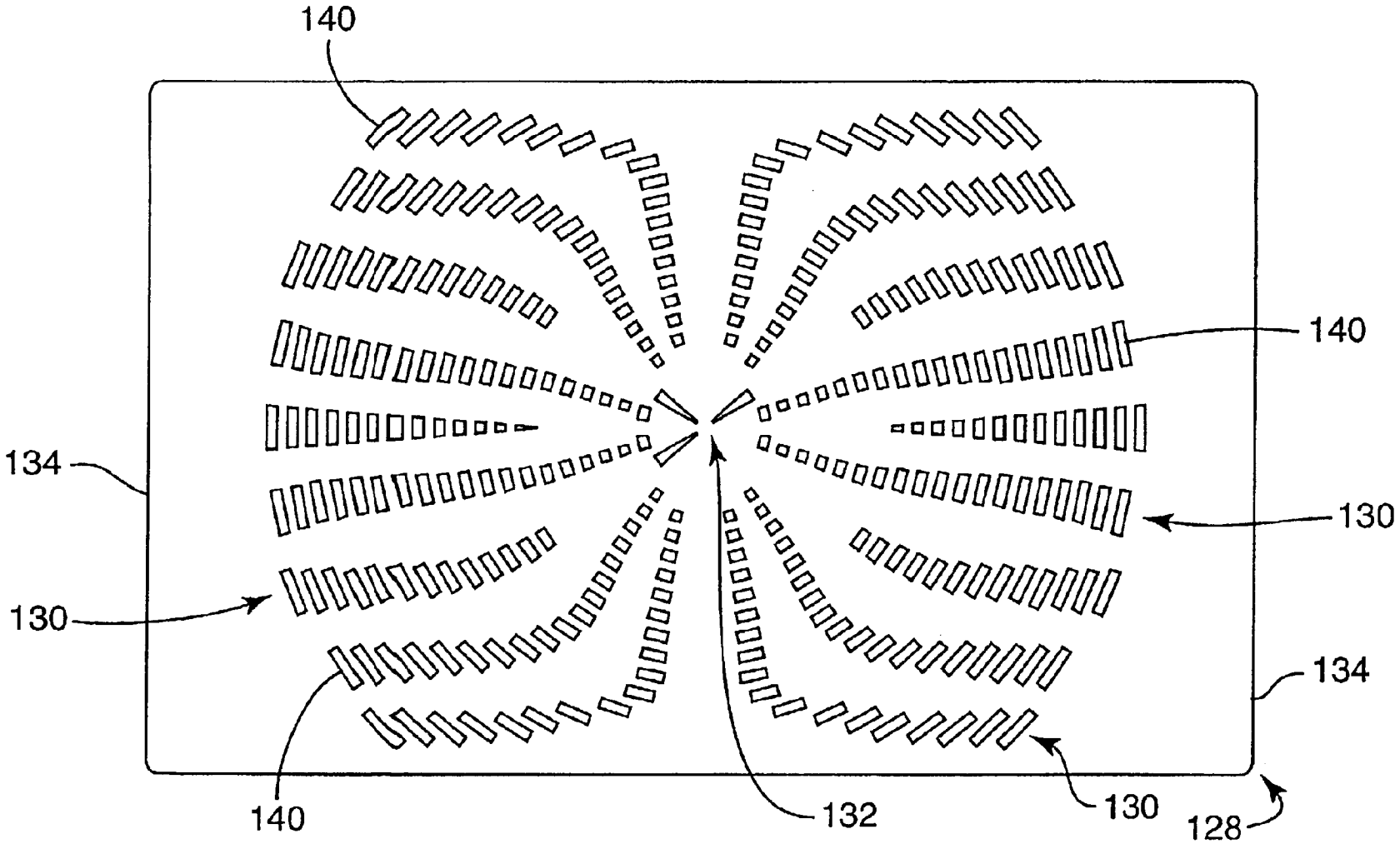
FIG. 5 is a plan view of another portion of the abrasive article of FIG. 2.
Figure 6:
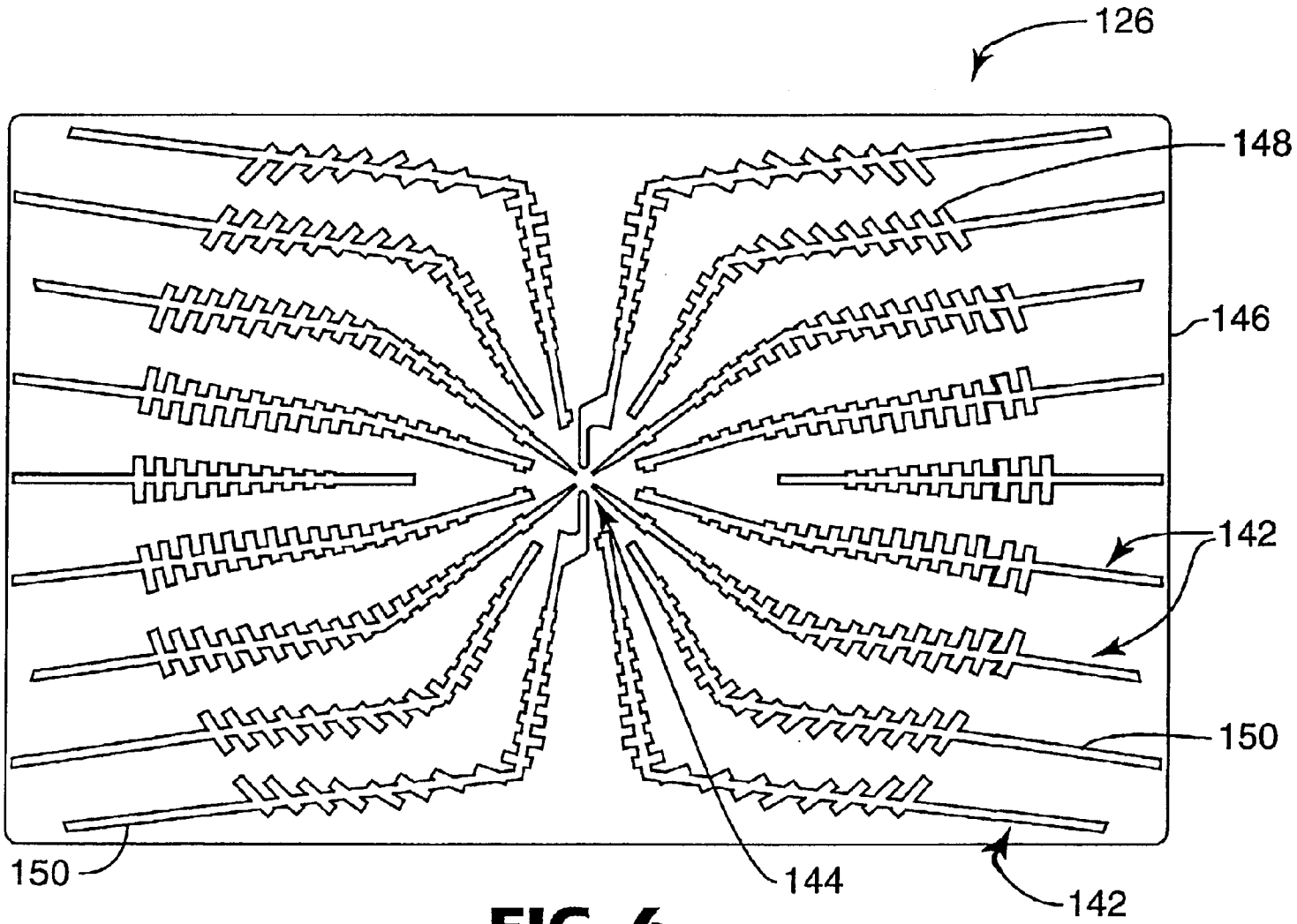
FIG. 6 is a plan view of still another portion of the abrasive article of FIG. 2.

Referring to FIG. 5, rigid element 128 of backing 118 comprises second channels 130 extending from a central portion, generally indicated at 132, and terminating near the edges 134 of the element 128. Each of the second channels 130 comprise a series of flow apertures 140 aligned in a discernable progression, extending through the element 128 and aligned with and coextensive with the first channels 104 of the polishing layer 100. As shown in FIG. 6, the resilient element 126 of the backing 118 also includes a plurality of second channels 142 extending from a central portion, generally indicated at 144 of the resilient element 126, and terminating near the edges 146. Each of the second channels 142 comprises a series of flow apertures 148 extending through the resilient element 126 and positioned to be coextensive with the second channel flow apertures 140 of the rigid element 128. The flow apertures 148 of the channels 142 on resilient element 126 are connected to one another along elongate channel components 150. The rigid element 128 is positioned between the resilient element 126 and the polishing layer 100, and the three layers are adhesively affixed to one another using a suitable PSA such as those available as 3M 9671LE and 3M 9471FL, described above.

The second channels 130 of the rigid element 128 and the second channels 142 of the resilient element 126 are aligned and co-extensive with one another so that flow apertures 140 of channels 130 are aligned with flow apertures 148 of channels 142 to permit the unimpeded flow of liquid, such as an electrolyte solution, through the backing 118. The flow apertures 140 and 148 may be of substantially the same dimensions. As mentioned, the invention is not limited to a particular embodiment for the backing 118. Additionally, the configurations for the channels 130 and 142 are intended as merely exemplary rather than exclusive of other designs or configurations. Although the apertures 140 and 148 are depicted as rectangular, those skilled in the art will appreciate that the apertures may be provided as circular, semicircular, triangular, or in any other shape and in any dimension possible. The backing may comprise the foregoing layers 128 and 126 or it may comprise a single layer, and the present invention is intended to encompass all such configurations.

In the assembled article 12, the polishing layer 100 is affixed or otherwise associated with the back-up pad 118 so that the first channels 104 are aligned with the second channels 130 of the rigid element 128 and all of the flow apertures 140 are within the side boundaries of the first channels 104. In this manner, as is further explained herein, the flow apertures 140, the second channels 130 of the rigid element 128 and second channels 130 of the resilient element 126 are aligned with one another to provide channels through the article 12. The first channel 104 and the second channels 130 and142 are configured with respect to one another so that the first surface 102 of the textured polishing layer is outside of the line of sight.

Figure 7:
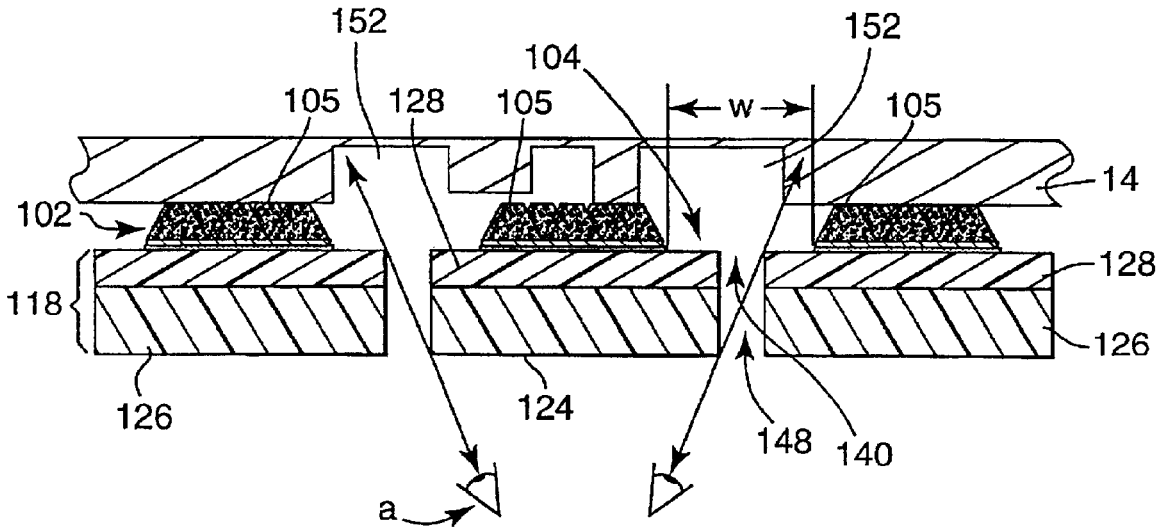
FIG. 7 is a side elevation of a section of an abrasive article according to the invention.

Referring to FIG. 7, the textured surface 102 is in contact with the surface of a silicon wafer 14 that typically includes at least a seed layer of metal on the exposed surface thereof. As mentioned, the abrasive article 12 is associated with the anode of an ECMD tool while the exposed and metallized surface of wafer 14 typically functions as the cathode of the tool. The anode (not shown) is typically positioned beneath the back-up pad 118 in proximity to the bottom-most surface 124 of the article 12. The width "w" of the channels 104 is configured in a manner that allows for the electrolytic deposition of metal onto the surface of the wafer 14 and mainly into the trenches and vias 152 while minimizing the plating of metal elsewhere on the surface of the wafer 14 or onto the textured surface 102 of the abrasive article 12.

One configuration of the textured surface 102 provides a width "w" for the channels 104 such that the channels 104 are wider than the flow apertures 140 of the rigid element 128 and the flow apertures 148 of the resilient element 126. In this configuration, an observer "a" positioned at the anode near the surface 124 and looking simultaneously through flow apertures 140, flow apertures 148 and first channel 104, would not be able to see the surface 102 in contact with the wafer 14. In other words, the configuration and the relative dimensions of the aforementioned apertures 140 and 148 and the channel 104 are chosen so that the interfacial contact between the first surface 102 and the wafer 14 is beyond such an observer's field of vision by, for example, 0.2 mm and typically by 0.5 mm.

In the foregoing arrangement of parts, an electrolyte solution is applied to the surface of the semiconductor wafer workpiece through the aforementioned flow apertures 140 and 148 and the first channel 102. Other areas of the wafer surface are blocked by the surface contact that is maintained between the wafer and the first surface 102. In an ECMD process, for example, the abrasive article of the invention can be used to first assist in the deposition of the metal onto the surface of the wafer, and then to polish or reduce the rate of deposition of the conductive material. ECMD processes can be performed on equipment such as that described in U.S. Pat. No. 6,176,992 to Talieh, for example. Commercial equipment useful in performing ECMD processes like those described herein include the "NuTool 2000" tool available from NuTool, Inc. of Milpitas, Calif. Abrasive articles according to the invention may be used in conjunction with such equipment.

In operation, the ECMD process applies a negative potential to a cathode associated with the wafer and a positive potential to an anode associated with the abrasive article or polishing pad. When current is established through the electrodes, the metal ions in the electrolyte solution begin to deposit onto the surface of the wafer. The metal ions are attracted to the surface of the wafer by the negative potential applied by the cathode. The positioning of the abrasive article on the surface of the wafer along with simultaneous polishing or rubbing action by the abrasive article prevent the build-up of metal in areas on the surface of the wafer outside of the vias and/of the interconnect lines.

In a second phase of operation, the wafer surface may be cleaned if needed and further polishing can be carried out using the abrasive article in the absence of electrical current or by reversing the polarity of the current. Less desirably, buffing/polishing can be carried out using a conventional polishing slurry.

The construction of the abrasive article of the present invention to provide flow channels meeting the aforementioned "line of sight" criteria additionally allows for the flow of the electrolyte through the article and deposition of metal onto the desired areas of the workpiece while minimizing the deposition of metal on the textured surface 102 of the abrasive layer 100 and on areas of the wafer surface outside of the via holes and trenches.

In another embodiment of the abrasive article of the invention, an additional rigid element may be affixed or associated with the back-up pad 118. In this embodiment, the additional rigid layer of material (e.g., polycarbonate) may be associated with the article 12 so that the resilient element 126 is positioned between similar or identical rigid elements having essentially the same pattern of flow apertures extending therethrough to permit the flow of electrolyte solution through the abrasive article, as is generally discussed herein.

It will be appreciated by those skilled in the art that the abrasive article of the invention can be manufactured with flow channels therethrough wherein the configuration of the channels differs from that depicted in the foregoing description, and the invention is not to be construed as limited in any way to the foregoing configuration of the flow channels. More generally, the invention is directed to abrasive articles having a textured polishing layer comprising a first channel extending through the textured polishing layer from a first surface to a second surface, a backing associated with the second surface of the textured polishing layer, the backing comprising a second channel coextensive with the first channel and extending through the backing with the first channel and the second channel establishing a line of sight through the article such that the first surface of the textured polishing layer is outside of the line of sight.

The present invention may be used in a method for the deposition of conductive material onto the surface of a semiconductor workpiece. In such a method, a semiconductor workpiece is utilized as a cathode and is placed in proximity to an anode such that electrical contact is made through the application of an plating solution between the anode and the surface of the semiconductor wafer upon the application of a electrical potential. An abrasive article, as described herein, is positioned in association with the anode between the anode and the cathode so that the abrasive surface of the article is in contact with the exposed surface of the semiconductor wafer. A first potential is applied to the anode and a second potential to the cathode, and a conductive electrolyte is applied to a semiconductor wafer through the first and second channels of the abrasive article onto preferred areas on the surface of a semiconductor workpiece where metal is plated onto the surface of the wafer from the solution. The surface layer of the abrasive article is used to impede the deposition of the conductive material on certain areas on the surface of the workpiece. Thereafter, the textured surface of the abrasive article may be used to polish/buff the deposited metal on the surface of the semiconductor workpiece.

Depending upon the particular polishing application, the force at the interface between the textured first surface 102 and the surface of the semiconductor wafer 14 is generally very low, often less than one pound (e.g., 0.45 kg) on, for example, a 200 mm wafer.

Additional details of the preferred embodiment of the invention will be further understood upon consideration of the following non-limiting Examples.

EXAMPLES

General Procedure A (Preparation of the Abrasive Article)

A polypropylene production tool was made by casting polypropylene on a metal master tool having a casting surface comprised of a collection of adjacent posts. The production tool included a multitude of cavities that were in the shape of posts. The post pattern was such that the adjacent bases of the posts were spaced apart from one another no more than about 740 micrometers (0.029 inch), and the height of each post was about 40 micrometers. There were about 13 lines/centimeter delineating the array of cavities. The production tool was secured to a metal carrier plate with a masking type pressure sensitive adhesive tape. A binder precursor was prepared using the ingredients mentioned in the Examples. The precursor was mixed using a high shear mixer until homogenous, and the precursor was then filtered through a 60 $\mu$m or 80 $\mu$m filter.

General Procedure B (Forming the Abrasive)

Channels were cut into polishing layers made according to the Examples. Subsequent layers such as polycarbonate or foam layers were also prepared with channels in a separate step allowing for different dimensions and geometry. This channel cutting process can be done using water jet, or laser ablation techniques. Conventional die cutting or sharp blade instruments can also be used. In this example Laser Machining, Inc. of Somerset, Wis., was contracted to laser cut the channels. After the channels were cut, the layers were aligned and laminated. The final product is then aligned and adhered to the platen of the ECMD tool.

Example 1

A binder precursor was prepared as a combination of 10 g of propoxylated-2-neopentyl glycol diacrylate sold under the trade designation "Sartomer SR 9003" available from Sartomer of Exton, Pa., 15 g of 2-phenoxyethyl acrylate sold under the trade designation "Sartomer SR 339" (also from Sartomer), 2.53 g of a dispersing agent (available as Disperbyk 111 from BYK Chemie of Wallingford, Conn.), 0.27 g of an initiator (Iragacure 819 from Ciba Giegy of Tarrytown, N.Y.), and 72 g of alumina oxide (available as "Tizox" alpha alumina from Ferro Corp. of Penn Yan, N.Y.). The abrasive precursor was mixed and then coated into the cavities of the production tool using a squeegee and a primed polyester film backing was brought into contact with the abrasive slurry contained in the cavities of the production tool. The resulting assembly was passed through a bench top laboratory laminator, commercially available from Chem Instruments (Model #001998). The assembly was continuously fed between two rubber rollers at a pressure between about 280–560 Pa (20–80 psi) and a speed setting of approximately 61 to 213 cm/min (2 to 7 ft/min). A quartz plate was placed over the assembly. The assembly was cured by passing the tool together with the backing and abrasive slurry under either two iron doped UV lamps, commercially available from American Ultraviolet Company or two ultraviolet "V" bulbs, commercially available from Fusion Systems, Inc., both of which were operated at about 157.5 Watts/cm (400 Watts/inch). The speed of the assembly was maintained between about 4.6–13.7 meters/minute (15–45 feet/minute) and the assembly was passed under the UV source twice. The resulting structured fixed abrasive was then removed from the polypropylene tooling.

Example 2

A binder precursor was prepared by combining approximately 50 g of an epoxy resin (3M Scotch-Weld 1838-L (Part A) from Minnesota Mining and Manufacturing Company, St. Paul, Minn.) with approximately 50 g of a second epoxy hardener (3M Scotch-Weld 1838-L (part B), also from Minnesota Mining and Manufacturing Company). The precursor was mixed and coated into the cavities of the production tool using a squeegee and a primed polyester film backing was brought into contact with the abrasive precursor contained in the cavities of the production tool. The assembly was then passed through a bench top laboratory laminator, commercially available from Chem Instruments, Model #001998. The assembly was continuously fed between the two rubber rollers at a pressure between about 280–560 Pa (20–80 psi) and a speed setting of approximately 61 to 213 cm/min (2 to 7 ft/min). The assembly was allowed to set undisturbed for 15 hours and then the resulting structured fixed abrasive was removed from the polypropylene tooling.

While the preferred embodiment of the invention has been described in detail, those skilled in the art will appreciate that changes or modifications can be made to the described embodiments without departing from the scope and spirit of the invention, as may be found in the appended claims.

What is claimed is:

1. An abrasive article suitable for the deposition and mechanical polishing of a conductive material, the article comprising:

a polishing layer having a textured surface comprising a binder and a second surface opposite the textured surface, the polishing layer further comprising a first channel extending therethrough; and a backing having a first backing surface and a second backing surface, the first backing surface associated with the second surface of the polishing layer, the backing comprising a second channel extending therethrough and coextensive with the first channel;

wherein the first channel and the second channel are dimensioned with respect to one another such that the textured surface of the polishing layer is outside of a line of sight extending through said abrasive article.

2. The abrasive article of claim 1, wherein the textured surface comprises a plurality of abrasive composites.

3. The abrasive article of claim 2, wherein the abrasive composites are precisely shaped abrasive composites.

4. The abrasive article of claim 1 wherein the first channel and the second channel are dimensioned with respect to one another such that the textured surface of the polishing layer is outside of a line of sight by at least about 0.2 mm.

5. The abrasive article of claim 1 wherein the first surface of the textured surface further comprises abrasive particles fixed within the binder.

6. The abrasive article of claim 1 wherein the polishing layer comprises a plurality of first channels and wherein the textured surface comprises a center portion and at least one edge, each first channel extending across the textured surface from the center portion to an area proximate to the at least one edge on the textured surface.

7. The abrasive article of claim 6 wherein each first channel has a variable width along the length thereof.

8. The abrasive article of claim 1 wherein the backing comprises a first backing layer and a second backing layer, the first backing layer being proximate to the second surface of the polishing layer, the first and second backing layers comprising different materials.

9. The abrasive article of claim 8 wherein the first backing layer comprises a material harder than the material of the second backing layer.

10. The abrasive article of claim 9 wherein the first backing layer comprises polycarbonate and the second backing layer comprises a foamed polymeric material.

11. The abrasive article of claim 1 wherein the second channel comprises a plurality of apertures extending through the backing and generally aligned with the first channel of the polishing layer.

12. The abrasive article of claim 11 wherein the plurality of apertures are of varying dimensions.

13. The abrasive article of claim 11 wherein each of the plurality of apertures is rectangular in shape.

14. The abrasive article of claim 1 wherein the backing comprises a first backing layer, a second backing layer and a third backing layer, the first backing layer being proximate to the second surface of the textured abrasive layer and the second backing layer positioned between the first and third backing layers, the first and second backing layers comprising different materials.

15. The abrasive article of claim 14 wherein the first backing layer comprises a material harder than the material of the second backing layer.

16. The abrasive article of claim 14 wherein the first backing layer and the third backing layer comprise the same materials.

17. The abrasive article of claim 14 wherein the first and third backing layers comprise polycarbonate and the second backing layer comprises a foamed polymeric material.

18. The abrasive article of claim 14 wherein the second channel comprises a plurality of apertures extending through the first, second and third backing layers and generally aligned with the first channel of the polishing layer.

19. The abrasive article of claim 16 wherein the plurality of apertures are of varying dimensions.

20. The abrasive article of claim 16 wherein each of the plurality of apertures is rectangular in shape.

* * * * *

UNITED STATES PATENT AND TRADEMARK OFFICE

CERTIFICATE OF CORRECTION

PATENT NO. : 6,838,149 B2
DATED : January 4, 2005
INVENTOR(S) : Lugg, Paul S.

It is certified that error appears in the above-identified patent and that said Letters Patent is hereby corrected as shown below:

Column 16,
Lines 62 and 64, delete the words "claim 16" and insert in place thereof -- claim 18 --.

Signed and Sealed this

Twenty-eighth Day of June, 2005

JON W. DUDAS
*Director of the United States Patent and Trademark Office*